US006223556B1

(12) United States Patent
De Keuster et al.

(10) Patent No.: US 6,223,556 B1
(45) Date of Patent: May 1, 2001

(54) INTEGRATED PARALLEL FLOW CONDENSER RECEIVER ASSEMBLY

(75) Inventors: Richard M. De Keuster; Lawrence W. Gabbey, both of Racine; Michael J. Swee, Oak Creek; Thomas J. Thielen, Kenosha, all of WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/448,815

(22) Filed: Nov. 24, 1999

(51) Int. Cl.[7] ..... F25B 39/04
(52) U.S. Cl. ..... 62/509; 165/132
(58) Field of Search ..... 62/509, 507, 474; 165/110, 132

(56) References Cited

U.S. PATENT DOCUMENTS

| | | | | |
|---|---|---|---|---|
| 4,649,719 | * | 3/1987 | Yanagisawa | 62/474 |
| 4,972,683 | | 11/1990 | Beatenbough . | |
| 4,993,455 | * | 2/1991 | Yanagisawa | 137/592 |
| 5,088,294 | | 2/1992 | Ando . | |
| 5,159,821 | | 11/1992 | Nakamura . | |
| 5,224,358 | | 7/1993 | Yamanaka et al. . | |
| 5,228,315 | | 7/1993 | Nagasaka et al. . | |
| 5,233,842 | | 8/1993 | Manning et al. . | |
| 5,289,697 | | 3/1994 | Hutchison . | |
| 5,394,710 | | 3/1995 | Matsuo et al. . | |
| 5,419,141 | | 5/1995 | Burk . | |
| 5,426,956 | | 6/1995 | Phillippe . | |
| 5,435,149 | | 7/1995 | Strong et al. . | |
| 5,505,253 | | 4/1996 | Heraud . | |
| 5,537,839 | | 7/1996 | Burk et al. . | |
| 5,546,761 | | 8/1996 | Matsuo et al. . | |
| 5,560,214 | | 10/1996 | Burk et al. . | |
| 5,582,027 | | 12/1996 | Baba et al. . | |
| 5,592,830 | | 1/1997 | Baba et al. . | |
| 5,619,861 | | 4/1997 | Yamanaka et al. . | |
| 5,628,206 | | 5/1997 | Baba . | |
| 5,666,791 | | 9/1997 | Burk . | |
| 5,813,249 | * | 9/1998 | Matsuo et al. | 62/509 |
| 5,868,002 | * | 2/1999 | Matsubayashi | 62/507 |
| 5,934,102 | * | 8/1999 | DeKeuster etal. | 62/509 |
| 5,988,267 | * | 11/1999 | Park et al. | 165/110 |
| 6,000,465 | * | 12/1999 | Kawahara | 165/132 |

* cited by examiner

*Primary Examiner*—Corrine McDermott
*Assistant Examiner*—Marc Norman
(74) *Attorney, Agent, or Firm*—Wood, Phillips, VanSanten, Clark & Mortimer

(57) ABSTRACT

Ease of service is provided in an integrated condenser (20) and receiver (22) including two nonhorizontal headers (24), a plurality of tubes (28) extending between the headers (24) to establish a plurality of hydraulically parallel flow pads between the headers (24); at least one partition (48, 50, 52) in each of the headers for causing refrigerant to make at least two passes, including an upstream pass and a downstream pass, through the condenser (20); and an elongated receiver (22) mounted on one of the headers (24). The elongated receiver (22) includes an interior chamber (61), an upper inlet (70) connected to a downstream side of the upstream pass for the flow of refrigerant form the upstream pass to the interior chamber (61), a lower liquid outlet (71) connected to an upstream side of the downstream pass for the flow of liquid refrigerant from the interior chamber (61) to the downstream pass, and a port (62) to allow access to interior chamber (61) for servicing the receiver (22). The port (62) includes a first nominally cylindrical interior surface (80), a second nominally cylindrical interior surface (82) spaced axially and radially outward from the first cylindrical interior surface (80), and a radially inwardly facing annular groove (84) in the second cylindrical surface (82). A plug (64) is provided and includes a nominally cylindrical exterior surface (92) and a radially outwardly facing annular groove (94) in the exterior surface mounting an annular seal (96). The plug (64) is removably received in the port (62) with the seal (96) mating with the first cylindrical surface (80) of the port (62). A retaining ring (108) is removably received in the annular groove (84) of the port (62) to releaseably retain the plug (64) in1 the port (62).

10 Claims, 4 Drawing Sheets

INTEGRATED PARALLEL FLOW CONDENSER RECEIVER ASSEMBLY

FIELD OF THE INVENTION

This invention relates to refrigeration systems such as air conditioning systems, and more specifically, to an integral receiver/condenser useful in such systems.

BACKGROUND OF THE INVENTION

Vapor compression refrigeration systems conventionally employ a condenser which receives a refrigerant in the vapor phase under relatively high pressure from a compressor. The condenser is operative to condense the refrigerant vapor to the liquid phase for ultimate transmittal to an evaporator whereat the refrigerant evaporates. Heat from the ambient is rejected to the refrigerant where it is absorbed as the latent heat of vaporization as the refrigerant evaporates. The now vaporized refrigerant is then directed to the compressor to be recycled through the system.

Conventionally such systems include a so-called receiver which is intended to receive liquid refrigerant from the condenser before it is transmitted to the evaporator. The primary purpose of the receiver is to assure that all refrigerant passed to an expansion device upstream of the evaporator is in the liquid phase. This means that the refrigerant quality is low and its enthalpy is also low to increase the evaporator's ability to absorb heat as the refrigerant evaporates. In this connection, the receiver acts as a reservoir for excess liquid refrigerant to assure that only liquid is fed to the expansion device in spite of system changes typically caused by the operation of the compressor. For example, in an automotive air conditioning system, the compressor is frequently stopped and started. Furthermore, when the engine to which the compressor is typically mechanically coupled is accelerating, compressor speed may also change, causing a change in the pressure at its inlet which in turn affects the flow rate of refrigerant in the system.

It is desirable to integrate the receiver with the condenser in many instances. For example, in so-called parallel flow condensers of the multipass type, integration of the receiver with the condenser assures that only liquid refrigerant will be fed to the last pass of the condenser which then acts solely as a subcooling pass. When such is accomplished, the increased subcooling further lowers the refrigerant quality while reducing the enthalpy of the refrigerant delivered to the evaporator to achieve the efficiencies mentioned earlier. Moreover, integration of the receiver with the condenser eliminates the need for a separate receiver/dryer elsewhere in the system and has the ability to reduce the total cost of the system as well as the quantity of refrigerant that must be charged into the system.

In this latter respect, it is well known that certain refrigerants are not environmentally friendly. For example, CFC 12 is thought to degrade the protection ozone layer surrounding the earth. Other refrigerants such as HFC 134*a*, while less damaging of the ozone layer, are thought to contribute to the so-called greenhouse effect which may be responsible for global warming. Because in automotive air conditioning systems, the compressor is driven by the vehicle engine, it cannot be hermetically sealed as in residential or commercial air conditioning units. As a consequence, there is the potential for escape of the refrigerant through compressor seals with the resulting deleterious effects on the environment. Thus, refrigerant charge volume is of substantial concern.

It is also known for receivers to be provided with means for filtering and/or drying the refrigerant to assure its purity, thereby avoiding inefficient operation. When such means for filtering and/or drying are provided in an integrated condenser/receiver, it is often desirable to service the receiver one or more times during the useable life of the condenser by replacing, replenishing, or refurbishing the means for filtering and/or drying. Thus, it is desirable to construct the receiver so that the means for filtering and/or drying can be selectively inserted into and removed from the receiver one or more times during the useable life of the condenser.

U.S. Pat. No. 5,934,102 issued to DeKeuster et al. discloses one exemplary example of a known integral condenser/receiver that allows for periodic servicing of the receiver. Specifically, DeKeuster et al. discloses a receiver (22) that is closed by a threaded cap (62). The cap (62) is removable and allows for a filter and/or a conventional drying material or desiccant to be introduced into the receiver (22). Other known integral receiver/condensers also included threaded plugs or caps that allow such servicing of the receiver. While many of these known constructions are acceptable for their purpose, there is always room for improvement.

SUMMARY OF THE INVENTION

It is a principal object of the invention to provide a new and improved integrated receiver/condenser for use in a refrigeration system. Typically, but not always, the improved receiver/condenser will be employed in an automotive air conditioning system.

According to the invention, a condenser for a refrigerant is provided and includes two spaced, non-horizontal, elongated headers. Tube slots are in the facing sides of the headers with the tube slots in one header being generally aligned with the tube slots in the other header. A plurality of tubes extend between the headers with their ends in corresponding ones of the slots to establish a plurality of hydraulically parallel flow paths between the headers. At least one partition is located in each of the headers for causing refrigerant to make at least two passes, including an upstream pass and a downstream pass, through the condenser. A refrigerant inlet is located in one of the headers. A refrigerant outlet is also located in one of the headers. An elongated receiver is mounted on one of the headers and has a longitudinal axis. The receiver has an interior chamber, a lower liquid outlet connected to an upstream side of the downstream pass for the flow of liquid refrigerant from the interior chamber to the downstream pass, and an upper inlet connected to a downstream side of the upstream pass for the flow of refrigerant from the upstream pass to the interior chamber. The elongated receiver further includes a port to allow access to the interior chamber for servicing the receiver. The port includes a first nominally cylindrical interior surface, a second nominally cylindrical interior surface spaced axially and radially outward from the first cylindrical interior surface, and a radially inwardly facing annular groove in the second cylindrical interior surface. The second cylindrical interior surface and the annular groove are nominally coaxial with the first cylindrical interior surface. A plug is provided for the port and includes first and second ends spaced by a nominally cylindrical exterior surface, and at least one radially outwardly facing annular groove in the exterior surface mounting an annular seal. The plug is removably received in the port with the annular seal mating with the first cylindrical interior surface of the port. A retaining ring is removably received in the radially inwardly facing annular groove of the port to releaseably retain the plug in the port.

In one form of the invention, the interior chamber includes a third nominally cylindrical surface for receiving a container of desiccant. The third cylindrical surface is nominally coaxial with the first cylindrical interior surface of the port and spaced radially inward from the first cylindrical interior surface.

In one form of the invention, the lower liquid outlet, the upper inlet, the interior chamber, and the port are all formed from a single piece of material.

Other objects and advantages will become apparent from the following specification taken in connection with the accompanying drawings.

DESCRIPTION OF THE PREFERRED EMBODIMENTS

Figure 1:
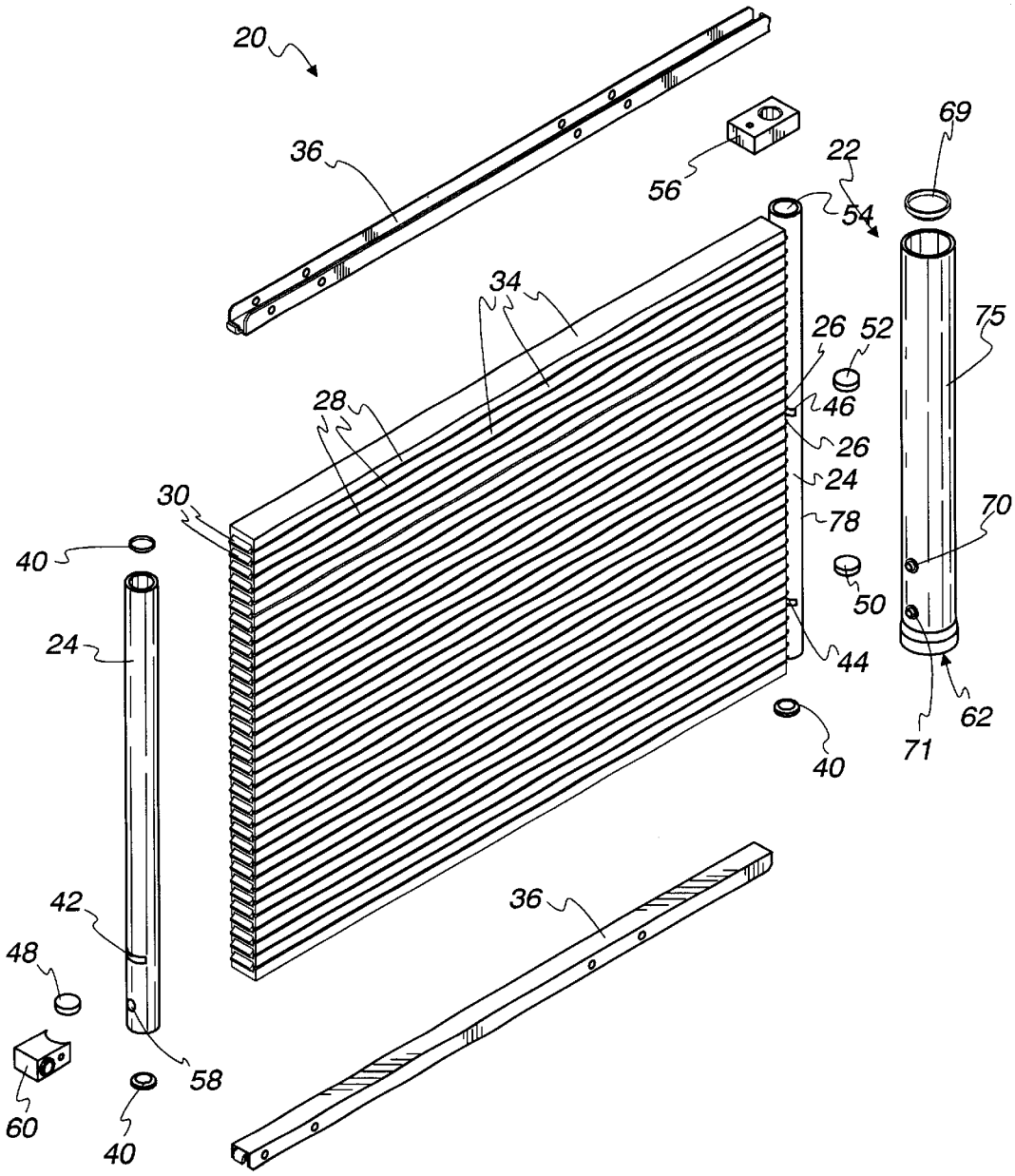
FIG. 1 is an exploded perspective, view of an integrated condenser/receiver made according to the invention.
Figure 2:
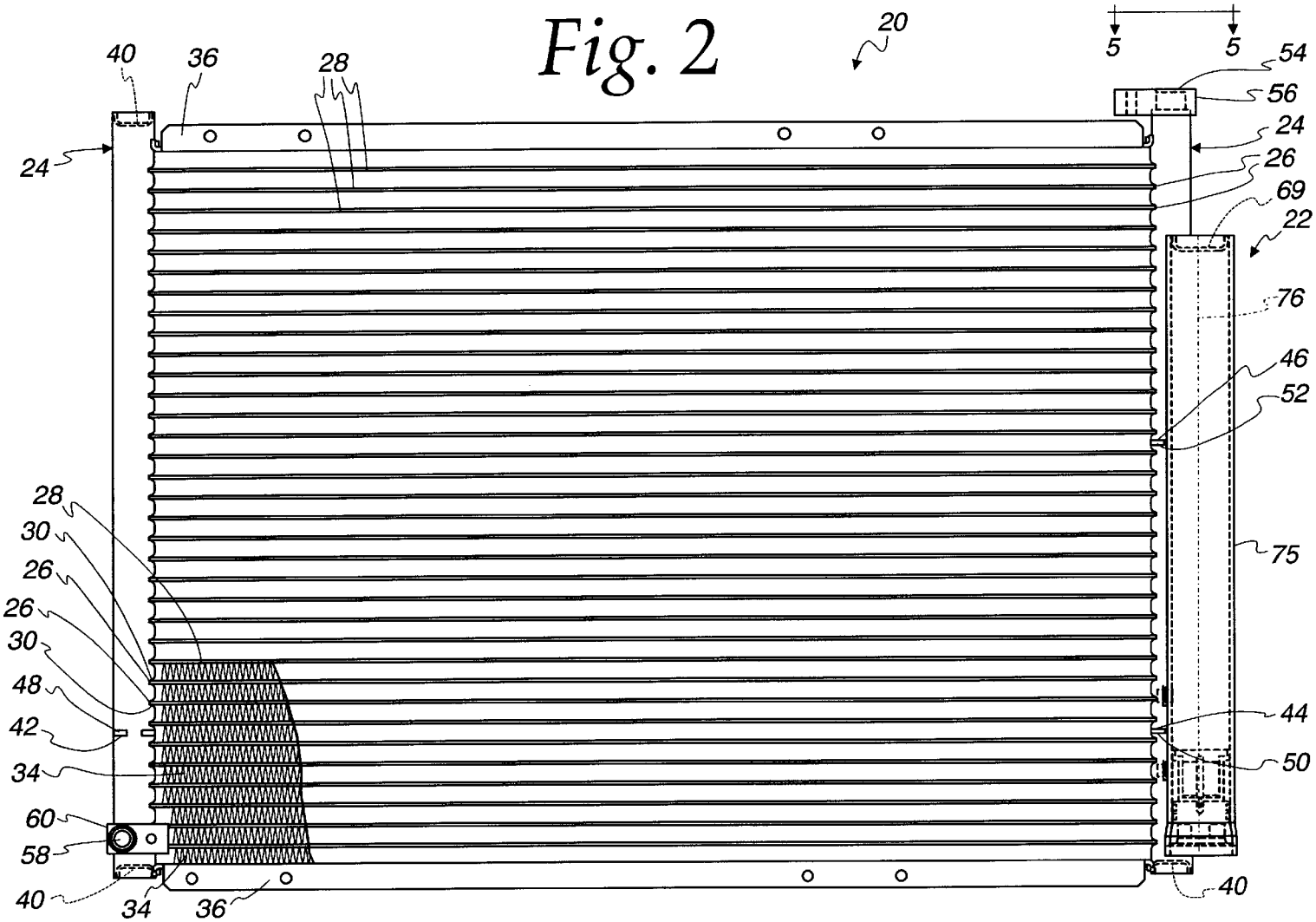
FIG. 2 is a front elevation of the condenser/receiver.

Exemplary embodiments of an integrated receiver/condenser are illustrated in the drawings and, with reference to FIGS. and 2, are seen to include a condenser, generally designated 20, and a receiver, generally designated 22, mounted thereon. The condenser includes a pair of tubular, elongated, vertically oriented headers 24. Each header 24 on its side facing the other includes a plurality of tube slots 26 which are aligned with the tube slots 26 in the opposite header 24. A plurality of multiport flattened tubes 28 extend between the headers 24 and have their ends 30 received in sealed relation in corresponding ones of the slots 26. Serpentine fins 34, shown only schematically in FIG. 1, extend between adjacent ones of the tubes 28 and, at the upper and lower sides of the condenser 20, side plates 36. In the usual case, the components will be made of aluminum and are bonded together as by brazing. Three of the ends of the tubular headers 24 are sealed as by end plugs 40 which are also typically brazed in place.

The embodiment illustrated is intended to be a three pass condenser and to this end the headers 24 include double slots 42, 44, and 46 each receiving an imperforate partition or baffle 48 50 and 52, respectively. In the embodiment illustrated, the slots 42, 44 and their associated baffles 48 and 50, are at the same location on their respective headers 24. In a preferred embodiment, the slots 42, 44 and 46 and the baffles 48, 50 and 52 are formed generally in the fashion shown in FIGS. 1–6 of commonly assigned U.S. Pat. No. 4,936,381 issued on Jun. 26, 1990 to Alley, the entire disclosure of which is herein incorporated by reference.

The rightmost header 24 includes an inlet opening 54 to which an inlet fixture 56 is brazed. The fixture 56 serves as the point of connection of the condenser into a vapor compression refrigeration system and it will be seen that the same is above the baffle 52.

Below the baffle 48, the leftmost header 24 includes a second opening 58 which in turn receives an outlet fixture 60 which serves as the outlet from the receiver/condenser to the refrigeration system. The fixture 60 is bonded to the header 24, such as by brazing.

If desired, one or more suitable mounting fixtures may also be brazed to the headers 24, as is known.

The receiver 22 is generally cylindrical and preferably no longer than the headers 24. It is preferably of a larger diameter than the headers 24 so as to provide sufficient volume to store the necessary amount of refrigerant as the system requires.

Figure 3:
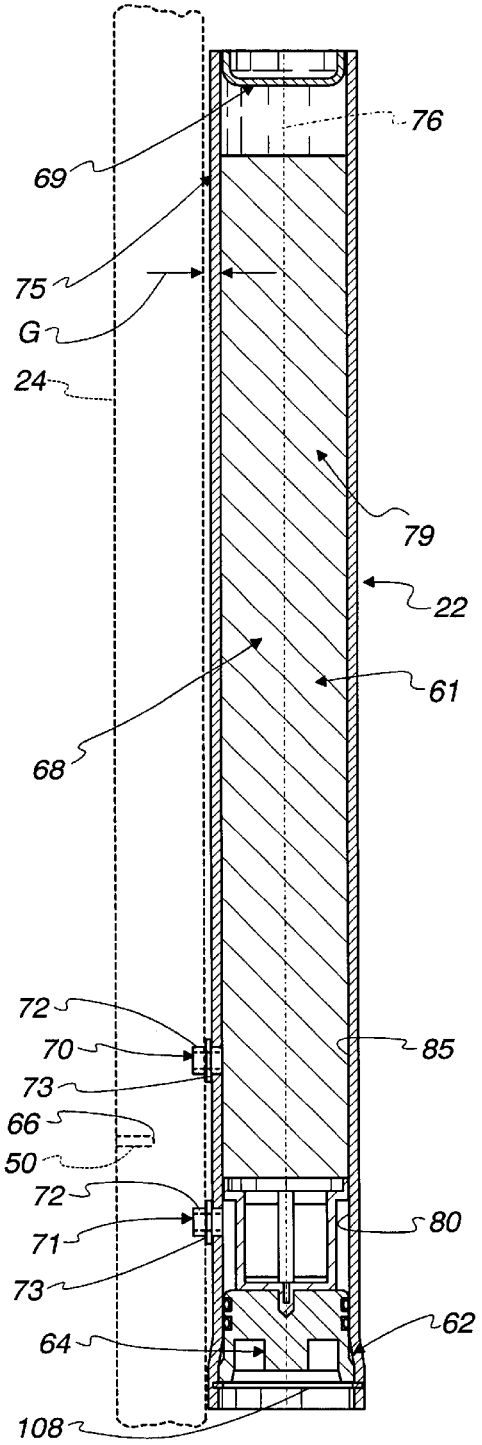
FIG. 3 is a sectional view showing one embodiment of the receiver of the condenser/receiver.
Figure 5:
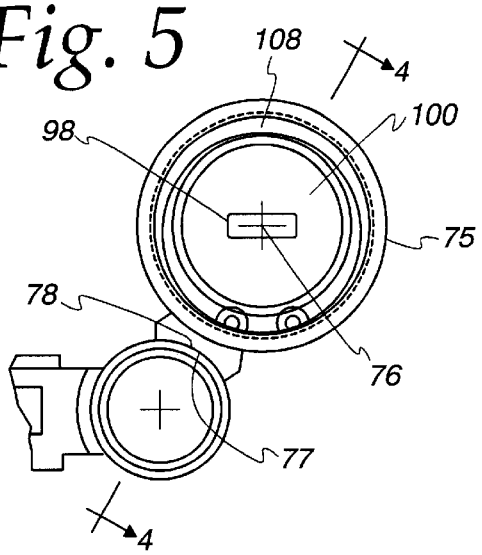
FIG. 5 is a partial view taken along line 5—5 in FIG. 2 showing the receiver of FIG. 4.
Figure 6:
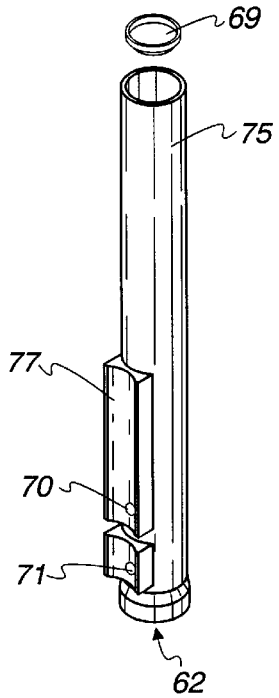
FIG. 6 is an exploded perspective view of the receiver of FIG. 4.

As best seen in FIG. 3, the receiver 22 includes an interior chamber 61 and, at its lower end, a port 62 that is closed by a removable plug 64. The plug 64 serves as a means whereby, after assembly of the receiver/condenser, a filter 66 and/or a conventional refrigerant permeable container of drying material or desiccant 68 may be introduced into and removed from the interior chamber 61 of the receiver 22 to allow the receiver to be serviced one or more times during the useable life of the receiver/condenser. The receiver 22 is closed at its upper end by an end plug 69 that is bonded in place, such as by brazing. The receiver 22 further includes an upper refrigerant inlet 70 and a lower refrigerant outlet 71. For the embodiment shown in FIGS. 1 and 3, the upper inlet 70 and lower outlet 71 are in the form of nipples which may be sealingly received in aligned openings (not shown) in the rightmost header 24 (shown by phantom lines in FIG. 3) and the receiver 22. The arrangement is such that the upper inlet 70 will be above the partition 50 while the lower outlet 71 will be adjacent the filter 66. FIG. 3 illustrates one form of the nipple that may be used in making the upper inlet 70 and the lower outlet 71. Specifically, the same is no more than a short section of tube 72 with a peripheral rib 73 about its center. The rib 73 prevents either end of the tube 72 from extending too far into either of the rightmost header 24 or the receiver 22. Further, the rib 73 serves to space the receiver 22 from the rightmost header 24 by the thickness of the rib 73 to minimize heat rejection from the rightmost header 24 to the receiver 22. As seen in FIGS. 1 and 5, the receiver 22 has a substantially cylindrical exterior surface 75 extending the length of the receiver 22 and defining a longitudinal axis 76.

Figure 4:
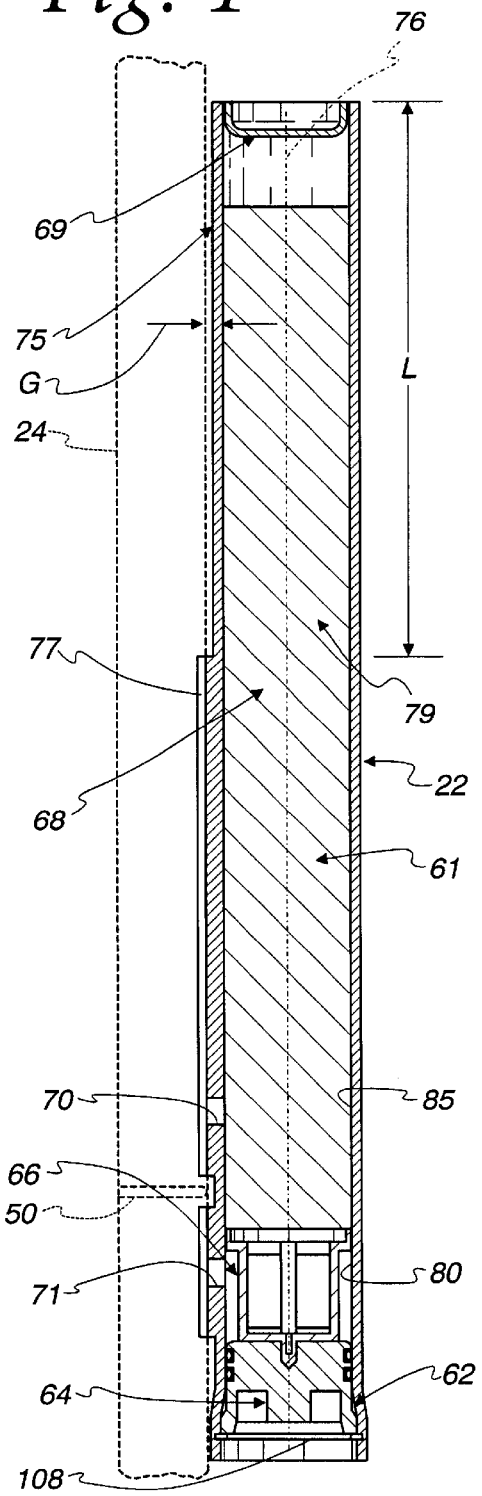
FIG. 4 is a sectional view showing another embodiment of the receiver.

FIGS. 4 and 5 illustrate another embodiment of the receiver 22. This embodiment of the receiver 22 is identical to the embodiment shown in FIG. 3, except for the upper inlet 70, the lower outlet 71, and an elongated saddle surface 77 that is formed on the surface 75 to conform to an exterior portion 78 of the rightmost header 24. The upper inlet 70 and lower outlet 71 are in the form of cylindrical bores which are sealingly brazed to aligned openings (not shown) in the rightmost header 24 (shown by phantom lines in FIG. 4). The saddle surface 77 is bonded, such as by brazing, to the rightmost header 24 to mount the receiver 22 thereon and to seal the upper inlet 70 and the lower outlet 71 to the respective aligned openings in the rightmost header 24. As best seen in FIG. 4, the receiver 22 is spaced by a gap G from the rightmost header 24 over a selected length L above the upper end of the elongated saddle surface 77 to thermally isolate relatively cooler refrigerant in an upper region 79 of the receiver 22 from relatively hotter refrigerant flowing through the uppermost portion of the rightmost header 24.

It will thus be appreciated that a three pass condenser is defined. Specifically, refrigerant may enter through the fixture 56 and be distributed by the rightmost header 24 to the tube ends 30 that are above the partition 52 to flow to the leftmost header 24. Once the refrigerant enters the leftmost header 24, it is distributed to the tube ends 30 of the tubes 28 that are above the partitions 48 and 50 and below the partition 52 to flow to the rightmost header 24. Once the refrigerant enters the rightmost header 24, it may exit the same via the upper inlet 70 to the receiver 22. In the receiver 22, any vapor phase refrigerant tends to migrate to the upper region 79 of the receiver 22 while the liquid phase refrigerant migrates toward the lower region of the receiver 22. As the refrigerant flows through the container of desiccant 68, the desiccant tends to absorb any water that is mixed with the refrigerant. In this regard, it should be noted that the container of desiccant 68 is shown somewhat schematically in FIG. 4 and may not entirely fill the interior chamber 61 so as to require all of the refrigerant to flow through the container of desiccant 68 as it migrates toward the upper or lower regions of the receiver 22. After the liquid phase refrigerant and vapor phase refrigerant are separated within the receiver 22, liquid refrigerant passes through the filter 66 and exits the receiver 22 via the lower outlet 71 to ultimately be returned to the leftmost header 24 via those tubes 28 that are located below the partitions 48 and 50. During this pass, the liquid will be subcooled as desired and ultimately will be returned to the system via the fitting 60. Of course, it should be understood that the invention is not limited to any specific number of passes although it will always be employed in a condenser having at least two passes.

Figure 7:
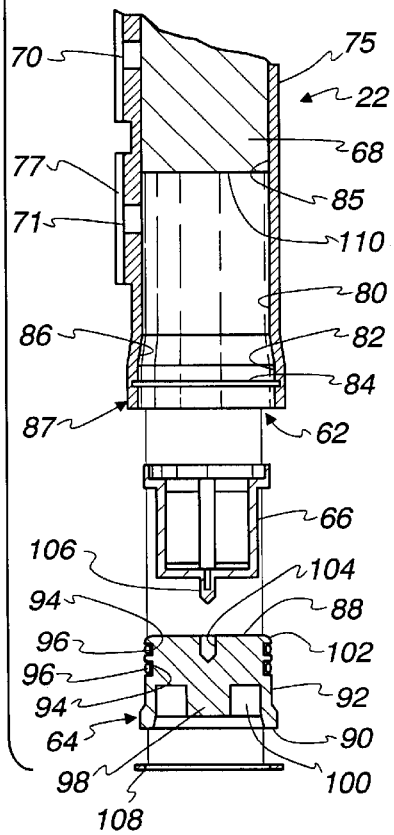
FIG. 7 is a partial, exploded sectional view of the receiver of FIG. 4.

Having described the general construction and operation of the integrated condenser 20 and receiver 22, the port 62 and the removable plug 64 will be described in more detail with reference to FIG. 7. In this regard, it should be understood that the details of the port 62 and the removable plug 64 are identical for both embodiments of the receiver 22 shown in FIGS. 3 and 4. The port 62 includes a first nominally cylindrical interior surface 80, a second nominally cylindrical interior surface 82 spaced axially and radially outward from the first cylindrical surface 80, and a radially inwardly facing annular groove 84 in the second cylindrical interior surface 82. In the illustrated embodiment, the cylindrical surface 80 is spaced radially outward from a cylindrical surface 85 of the interior chamber that receives the container of desiccant 68. Preferably, the first and second interior cylindrical surfaces 80 and 82 and the annular groove 84 are nominally coaxial with each other and nominally coaxial with the cylindrical surface 85 of the interior chamber 61. The port 62 further includes a cone shaped transition 86 between the first and second cylindrical interior surfaces 80 and 82. It should be noted that the interior chamber 61 includes a portion of the cylindrical interior surface 80. Preferably, the interior chamber 61, port 62, upper inlet 70, lower inlet 71, and cylindrical exterior surface 75 are all formed from a one piece extrusion, with the surface 82 and the transition 86 being generated by deforming an open end 87 of the receiver 22 radially outward, such as by flaring or swaging. Additionally, for the embodiment of the receiver 22 shown in FIG. 4, it is preferred that the saddle surface 77 also be formed as part of the same one piece extrusion with the interior chamber 61, port 62, upper inlet 70, lower inlet 71 and cylindrical exterior surface 75.

The plug 64 has first and second ends 88 and 90 spaced by a nominally cylindrically exterior surface 92. In the illustrated embodiment, a pair of radially outwardly facing annular grooves 94 are formed in the exterior surface 92 and mount respective annular seals 96, such as resilient o-ring seals. In this regard, it should be understood that the pair of seals 96 are redundant, and that in some applications only one seal 96 may be required. As best seen in FIGS. 3 and 5, a gripable tab 98 is formed in the end 90 surrounded by a relief 100. While the rectangular shape of the tab 98 is preferred, other shapes, such as cylindrical, may also be employed. Preferably, the plug 94 also includes a lead-in chamfer 102 transitioning between the end 88 and the cylindrical exterior surface 92 to aid in the insertion of the plug 64 into the port 62. A blind bore 104 is formed in the end 88 and receives an alignment pin 106 of the filter 66.

In the assembled state of the receiver 22, the plug 64 is inserted into the port 62 with the annular seals 96 mating with the cylindrical surface 80 to prevent leakage of refrigerant from the receiver 22. In this regard, the cone shaped transition 86 helps to compress the seals 96 for engagement with the cylindrical surface 80 and to prevent damage to the seals 96 by the groove 84.

A suitable, conventional retaining ring 108 is removably received in the groove 84 to releaseably retain the plug 64 in the port 62. In the illustrated embodiment, the filter 66 is slightly compressed between the plug 64 and a shoulder 110 that transitions between the cylindrical surfaces 85 and 80 to prevent leakage of refrigerant around the filter 66. The filter 66 is maintained in proper alignment in the interior chamber 61 by its engagement with the shoulder 110, the cylindrical surface 80, and the blind bore 104 of the plug 64.

It should be understood that while the receiver 22 has been illustrated in connection with both a filter 66 and the container of desiccant 68, the invention does not require that either or both of these components be provided. For example, in some applications, the container of desiccant may not be required and thus will be eliminated. Similarly, in other applications, the filter 66 may not be required and accordingly will be eliminated. In the latter situation, the container of desiccant 68 and the shoulder 110 may extend downwardly to be adjacent to the end 88 of the plug 64, with the plug 64 installed in the port 62. It should also be understood that the details of the filter 66 and container of desiccant 68 will vary as dictated by the requirements of the particular application.

It should be appreciated that in the illustrated embodiment, the provision of the port 62 on the lower end of the receiver 22 allows for the filter 66 to be removed without having to remove the container of desiccant 68 when servicing the receiver, if only the filter 66 requires replacement or cleaning. On the other hand, it should be understood that in other applications it may be more desirable to provide the port 62 on the upper end of the receiver 22. The advantage of this latter construction is that it would allow servicing of the receiver 22 from above, which would be more convenient in a number of automotive applications.

Figure 8:
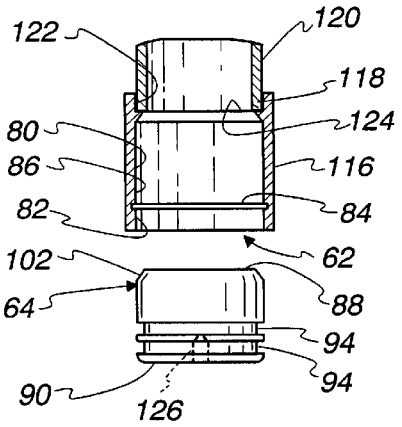
FIG. 8 is a partial, exploded sectional view of another embodiment of the receiver.

FIG. 8 shows another embodiment for the receiver 22. In this embodiment, the port 62 is formed in a separate piece or fitting 116, which is then bonded, such as by brazing, to a nominally cylindrical end 118 of a separate receiver tank 120. In this regard, the fitting 116 includes a nominally cylindrical interior surface 122 that terminates in a shoulder 124 to allow the fitting 116 and the receiver tank 120 to be accurately positioned for bonding. The remainder of the port 62 is substantially identical to the embodiment shown in FIG. 7, except that the cylindrical surface 82 is not spaced as far radially outward from the cylindrical surface 80 and, accordingly, the cone shaped transition 86 between the first and second cylindrical surfaces 80 and 82 is much smaller.

FIG. 8 also shows another embodiment for the plug 64 wherein the relief 100 is not provided and the grip tab 98 has been replaced with the threaded opening 126 that can be engaged with the threaded tool used for removal of the plug 64 from the port 62.

It should be understood that the embodiments of the port 62 and the plug 64 shown in FIG. 8 are compatible with both embodiments of the inlet 70 and outlet 71 shown in FIGS. 3 and 4.

It should be understood that while the preferred embodiments of the receiver 22, port 62, and plug 64 have been described in connection with a specific embodiment of a multipass, parallel flow condenser 20, the exact details of the condenser 20 will vary as dictated by the requirements of each specific application of the integrated condenser 20 and receiver 22. Accordingly, the details of the individual components and features 22-68 may vary considerably within the spirit of the invention, and no limitation to these details is intended unless expressly recited in the claims. As one example, any of the disclosed embodiments for the port 62 and the plug 64 could be incorporated in the integrated condenser (20) and receiver (22) of U.S. Pat. No. 5,934,102, discussed in the Background section.

It should be appreciated that by removably retaining the plug 64 in the receiver 22 with the retaining ring 108, a simple construction is provided that allows servicing of the receiver 22 one or more times during its useable life. In comparison to known constructions that utilize a threaded plug, the use of the retaining ring 108 offers reduced manufacturing and inspection costs. Further, again in comparison to known constructions that utilize threaded plugs, the use of the retaining ring 108 requires less length of the receiver 22 to be dedicated to the plug 64.

What is claimed is:

1. A condenser for a refrigerant comprising:

two spaced, nonhorizontal elongated headers;

tube slots in the facing sides of said headers with the tube slots in one header generally being aligned with the tube slots in the other header;

a plurality of tubes extending between the headers with their ends in corresponding ones of the slots to establish a plurality of hydraulically parallel flow paths between the headers;

at least one partition in each of said headers for causing refrigerant to make at least two passes, including an upstream pass and a downstream pass, through said condenser;

a refrigerant inlet in one of said headers;

a refrigerant outlet in one of said headers;

an elongated receiver mounted on one of said headers and having an interior chamber, an upper inlet connected to a downstream side of said upstream pass for the flow of refrigerant from the upstream pass to the interior chamber, a lower liquid outlet connected to an upstream side of said downstream pass for the flow of liquid refrigerant from the interior chamber to the downstream pass, and a port to allow access to the interior chamber for servicing the receiver, said port including a first nominally cylindrical interior surface, a second nominally cylindrical interior surface spaced axially and radially outward from the first cylindrical interior surface, and a radially inwardly facing annular groove in the second cylindrical interior surface, the second cylindrical interior surface and the annular groove being nominally coaxial with the first cylindrical interior surface;

at least one annular seal;

a plug having first and second ends spaced by a nominally cylindrical exterior surface, and at least one radially outwardly facing annular groove in the exterior surface mounting said at least one annular seal, said plug removably received in said port with said at least one annular seal mating with said first cylindrical interior surface of said port; and a retaining ring removably received in said radially inwardly facing annular groove of said port to releaseably retain said plug in said port.

2. The condenser of claim 1 wherein said interior chamber comprises a third nominally cylindrical surface for receiving a container of desiccant, and said third cylindrical surface is nominally coaxial with said first cylindrical interior surface of said port and spaced radially inward from said first cylindrical interior surface.

3. The condenser of claim 1 wherein said lower liquid outlet, said upper inlet, said interior chamber, and said port, are all formed from a single piece of material.

4. The condenser of claim 3 wherein said single piece of material is an extrusion.

5. The condenser of claim 1 wherein said interior chamber is defined in a first piece of said receiver and said port is formed in a second piece that is brazed to an open end of said first piece.

6. The condenser of claim 1 wherein said receiver has a substantially cylindrical exterior surface with an elongated saddle surface formed thereon to conform to an exterior portion of said one of said headers, said saddle surface brazed to said one of said headers to mount the receiver thereon.

7. The condenser of claim 6 wherein said receiver is spaced from said one of said headers over a longitudinal length spaced upwardly from said elongated saddle to thermally isolate relatively cooler refrigerant received in an upper region of said interior chamber from relatively hotter refrigerant flowing through said one of said headers.

8. The condenser of claim 1 wherein said port is defined in a lower end of said elongated receiver.

9. The condenser of claim 1 wherein said port is defined in an upper end of said elongated receiver.

10. The condenser of claim 1 wherein said upper inlet and said lower liquid outlet each comprises a nipple tube having a peripheral rib.

* * * * *